US006439372B1

(12) United States Patent
Wittmaier

(10) Patent No.: US 6,439,372 B1
(45) Date of Patent: Aug. 27, 2002

(54) CONVEYOR DEVICE

(75) Inventor: Klaus Wittmaier, Vaihingen (DE)

(73) Assignee: Schober GmbH Werkzeug - und Maschinenbau, Eberdingen-Hochdorf (DE)

( * ) Notice: Subject to any disclaimer, the term of this patent is extended or adjusted under 35 U.S.C. 154(b) by 0 days.

(21) Appl. No.: 09/647,456

(22) PCT Filed: Jan. 26, 1999

(86) PCT No.: PCT/EP99/00466

§ 371 (c)(1),
(2), (4) Date: Mar. 8, 2001

(87) PCT Pub. No.: WO99/48632

PCT Pub. Date: Sep. 30, 1999

(30) Foreign Application Priority Data

Mar. 25, 1998 (DE) ..... 198 13 139

(51) Int. Cl.[7] ..... B65G 29/00
(52) U.S. Cl. ..... 198/478.1; 271/275; 271/308
(58) Field of Search ..... 198/478.1; 271/275, 271/308, 306

(56) References Cited

U.S. PATENT DOCUMENTS

| | | | | |
|---|---|---|---|---|
| 1,949,152 A | | 2/1934 | Fankboner | |
| 2,454,285 A | * | 11/1948 | Krueger | 226/96 |
| 2,500,465 A | * | 3/1950 | Meyer | 198/22 |
| 2,576,882 A | * | 11/1951 | Koole et al. | 198/1 |
| 3,036,693 A | * | 5/1962 | Glocker | 198/25 |
| 3,762,697 A | * | 10/1973 | Bolza-Schunemann | 270/6 |
| 4,190,241 A | | 2/1980 | Krueger | |
| 4,373,713 A | * | 2/1983 | Loebach | 271/303 |
| 4,522,387 A | * | 6/1985 | Leuthold | 271/187 |
| 4,613,033 A | * | 9/1986 | Focke et al. | 198/457 |
| 4,729,282 A | * | 3/1988 | Kasdorf | 83/26 |
| 4,790,061 A | * | 12/1988 | Walker | 29/563 |
| 4,850,581 A | * | 7/1989 | Hayakawa et al. | 271/10 |
| 4,938,337 A | * | 7/1990 | Jowitt et al. | 198/377 |
| 5,074,397 A | * | 12/1991 | Mukai et al. | 198/343.1 |
| 5,081,823 A | | 1/1992 | van der Ent | |
| 5,096,042 A | * | 3/1992 | Loll | 198/441 |
| 5,112,033 A | * | 5/1992 | Breton | 270/47 |
| 5,180,160 A | * | 1/1993 | Belanger et al. | 271/315 |
| 5,238,239 A | * | 8/1993 | LaChapelle | 271/275 |
| 5,370,383 A | * | 12/1994 | Kulpa | 271/273 |
| 5,647,586 A | * | 7/1997 | Novick et al. | 271/182 |
| 5,730,435 A | * | 3/1998 | Belanger et al. | 270/52.14 |
| 5,782,338 A | * | 7/1998 | Schuster et al. | 198/803.13 |
| 5,855,368 A | * | 1/1999 | Middelberg et al. | 271/272 |
| 5,897,114 A | * | 4/1999 | Arikawa et al. | 271/272 |
| 5,954,330 A | * | 9/1999 | Rabindran et al. | 271/270 |
| 6,029,795 A | * | 2/2000 | Janssen et al. | 198/465.4 |
| 6,220,591 B1 | * | 4/2001 | Stauber | 271/225 |
| 6,247,692 B1 | * | 6/2001 | Schaefer et al. | 270/60 |

FOREIGN PATENT DOCUMENTS

| | | |
|---|---|---|
| CH | 355 126 | 8/1961 |
| DE | 31 14 718 | 10/1982 |
| DE | 33 09 525 | 9/1984 |
| EP | 0 338 297 | 10/1989 |
| EP | 0 537 125 | 4/1993 |
| GB | 1 377 443 | 12/1974 |

* cited by examiner

*Primary Examiner*—Christopher P. Ellis
*Assistant Examiner*—Rashmi Sharma
(74) *Attorney, Agent, or Firm*—Young & Basile, P.C.

(57) ABSTRACT

The invention relates to a conveyor device, including a conveyor belt for transporting workpieces out of a cutting or stamping device and a placement star wheel for putting upright the workpieces, which are delivered horizontally upright. The placement star wheel is mounted downstream of the conveyor strip. Conveyor bands which grip the workpieces on top and/or at the bottom are provided between the conveyor belt and the delivery star wheel. The conveyor bands move at essentially the same speed as the conveyer belt and the placement star wheel and are arranged in such a way to guide the workpieces into the receiving elements of the placement wheel.

18 Claims, 4 Drawing Sheets

1
3
4
5
6
7

CONVEYOR DEVICE

BACKGROUND

The invention pertains to a conveyor device with a conveyor belt for transporting workpieces from a cutting or punching machine and with a star-shaped delivery element connected to the outlet end of the conveyor belt for placing the horizontally received workpieces upright.

EP 338 297 B1 discloses a conveyor device that aligns circular workpieces punched out of a material strip with minimal punching waste relative to one another in columns and rows. These aligned workpieces can then be easily stacked and packaged. In methods of this type, the workpieces are usually transferred from the conveyor belt to a star-shaped delivery element by means of acceleration rollers, wherein the workpieces are placed upright into an essentially vertical alignment from the horizontal alignment by the star-shaped delivery element and stacked as well as packaged in this upright position. In the manufacture of wadding pads in particular, it had been determined that the pads are damaged or at least deformed by the acceleration rollers during the transfer of the wadding pads from the conveyor belt to the star-shaped delivery element and/or that the pads are introduced into the star-shaped delivery element in an inaccurate or improperly spaced fashion. Consequently, this method is not or is only conditionally suitable for workpieces of this type.

SUMMARY OF THE INVENTION

The invention is based on the objective of providing a conveyor device that allows easy stacking of workpieces with the least possible damage such that they can be supplied to a packaging machine.

According to the invention, this objective is attained by a conveying and guiding unit that takes hold of the workpieces on the lower and/or upper side and is provided between the conveyor belt and the star-shaped delivery element, by a conveying and guiding unit that has essentially the same conveying speed as the conveyor belt and the star-shaped delivery element, and by a conveying and guiding unit that is arranged in such a way that it guides the workpieces into the receptacles of the star-shaped delivery element.

The design of the conveyor device in accordance with the invention provides the substantial advantage that the workpieces are transferred from the conveyor belt to the conveying and guiding unit at a constant speed, and thus the workpieces are treated more carefully than during an accelerated transfer. In addition, a targeted guidance is achieved due to the contact of the conveying and guiding unit with the upper side as well as the lower side of the workpiece such that the workpiece is precisely placed into the star-shaped delivery element. This means that the workpieces are guided into the receptacles of the star-shaped delivery element and not thrown or flung into the delivery element as is the case with the state of the art. Since the workpieces are not accelerated, the workpieces do not have to be decelerated and the workpieces are uniformly transferred from the conveyor belt into the star-shaped delivery element by the conveying and guiding unit. Since no changes in speed are required, i.e., since no acceleration and no deceleration of the workpieces occurs, the machine is able to operate at higher speeds, so that the material throughput of the device according to the invention is higher than in comparable devices known from the state of the art.

According to one refinement of the invention, it is proposed that the conveying and guiding unit be formed by a lower and an upper conveyor band, wherein the conveyor band is formed by at least two rings, in particular, O-rings, that are arranged adjacent to one another. This provides the significant advantage that planar conveying forces transmitted onto the workpiece and the conveyor bands only need to apply minimal force to the workpieces. Due to the division of the conveyor band into conveyor strips or O-rings, the conveyor band can be easily moved into the region between the receptacles of the star-shaped delivery element which, in particular, are formed by receptacle fingers. The transfer of the workpieces from the conveyor bands to the star-shaped delivery element can be easily realized in this fashion.

According to one variant of the invention, it is proposed that the starshaped delivery element and the upper and the lower conveyor bands feature separate drives. In order to prevent differential conveying speeds between the upper and the lower conveyor bands, these components are provided with a common drive in another embodiment of the invention. It is also proposed that the star-shaped delivery element and the conveying and guiding unit are provided with a common drive in order to ensure that the workpiece is not accelerated or decelerated during the transfer of the workpieces from the conveyor bands to the star-shaped delivery element. The common drive is, in particular, formed by a driving belt that is placed around the drive elements of the conveying and guiding unit and the star-shaped delivery element, respectively.

According to one embodiment, it is proposed that the star-shaped delivery element is driven by the conveying and guiding unit. This provides the significant advantage that, if fluctuations in the conveying speed occur, such fluctuations are transferred to the star-shaped delivery element by the conveying and guiding unit so that relative synchronization is preserved.

A receptacle, into which the workpieces are successively deposited in an upright fashion, is preferably arranged at the outlet of the star-shaped delivery element, where the workpieces assume an essentially vertical position. This receptacle contains a slotted end. The conveyor fingers of the star-shaped delivery element engage the slots, and the end of the receptacle lifts the workpieces out of the star-shaped delivery element. This transfer of the workpieces into the receptacle is generally known, but the removal of the workpieces from the star-shaped delivery element is significantly simplified because the workpieces are inserted into the star-shaped delivery element by the conveying and guiding unit with little force and consequently they are anchored less rigidly in the delivery element.

A tube or a tubular collection device is preferably connected to the receptacle. In one preferred embodiment, this tubular collection device is formed by several rods that are arranged parallel to one another and between which the workpieces are guided, if so required, with low friction. The friction can be adjusted such that the workpieces are held in a vertical alignment while not impairing the conveying process in the longitudinal direction of the connection device. The rods merely apply pointlike focus to the edges of the workpieces such that the frictional forces remain minimal. The use of rods provides the additional advantage that the cross section of the collection device can be optimally adapted to different cross-sectional shapes of the workpieces. Round workpieces, oval workpieces, rectangular workpieces, etc., can be collected and conveyed in this fashion.

According to one additional development of the invention, it is proposed that a conveyor device, in particular, a conveyor finger, is provided which engages the collection device and can be displaced in the direction of the longitudinal axis of the collection device. The workpieces in the collection device are additionally conveyed and/or ejected by means of this conveyor finger. After a certain quantity of workpieces are deposited behind the star-shaped delivery element or in the collection device, the conveyor finger is moved either into the star-shaped delivery element or into the collection device, respectively, and moves either with these workpieces or pushes these workpieces in the conveying direction until another defined quantity of workpieces is deposited, whereafter it pushes the remaining workpieces out of the collection device into a transfer cartridge arranged behind the collection device. After the filling process, this transfer cartridge is moved into the operating path of an ejector unit such that the workpieces in the transfer cartridge can be pushed into a filling cartridge by means of the ejector unit, in particular, a ram. This filling cartridge represents part of a packaging machine, which performs the final packaging of the workpieces in the filling cartridge.

DETAILED DESCRIPTION OF THE DRAWING

Additional advantages, characteristics and details of the invention are disclosed in the subordinate claims as well as in the following description, which describes one particularly preferred embodiment in greater detail with reference to the figures. In this respect, the characteristics illustrated in the figures and cited in the claims and in the description are essential to the invention individually or in arbitrary combinations. Shown in the drawing are:

DETAILED DESCRIPTION

Figure 1:
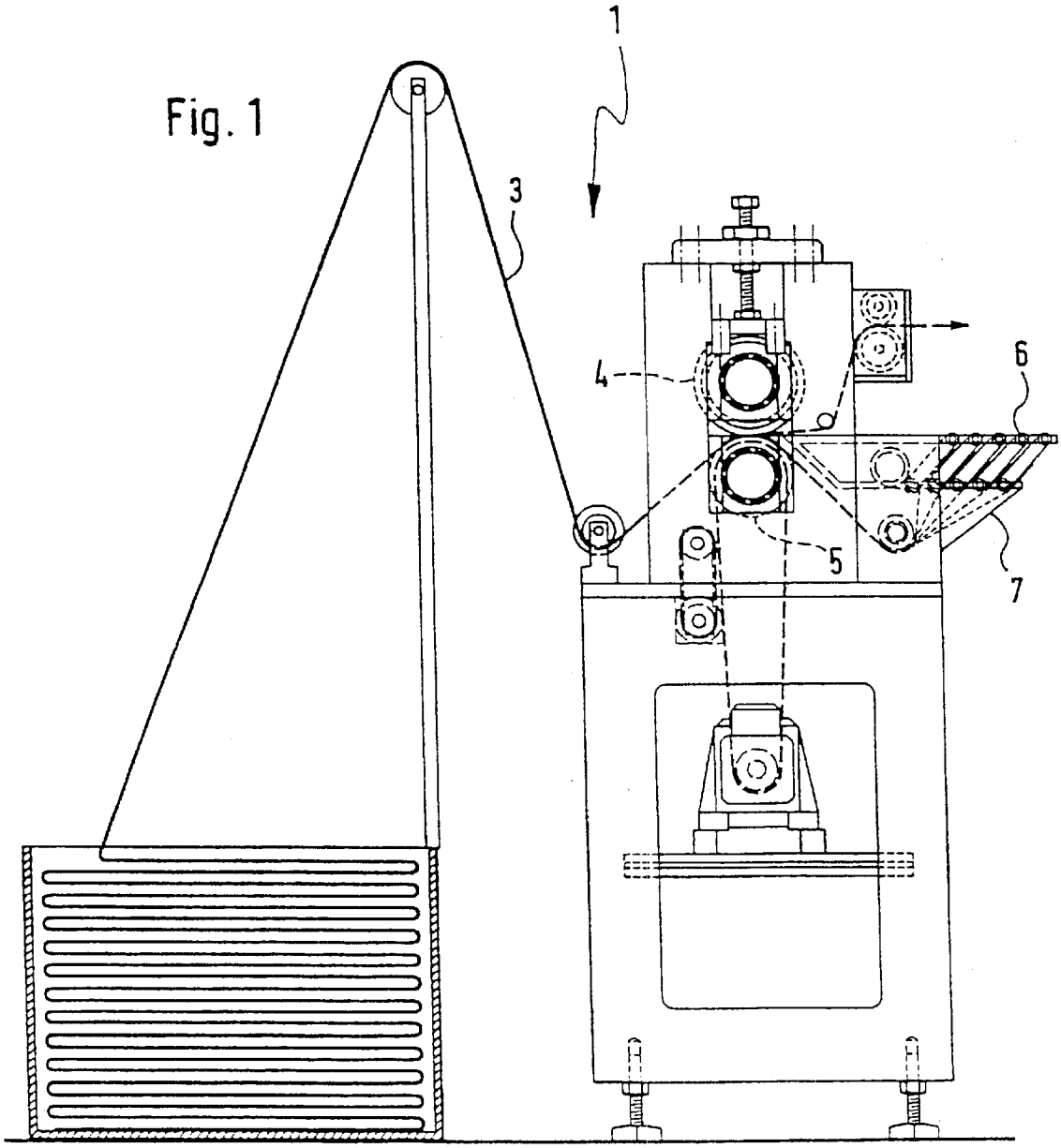
FIG. 1 is a side view of a device for cutting or punching workpieces out of a material strip.

FIG. 1 shows a device that is labeled, as a whole, with the reference number 1 for cutting or punching round workpieces 2 (FIG. 3), e.g., wadding pads, out of a material strip 3. This device 1 has a conventional design and is provided with a rotary cutting cylinder 4 with a mating roll 5. The workpieces 2 are placed onto a conveyor belt 6 and the remaining punching material 7 is transported away in the form of punching waste and usually wound up.

Figure 2:
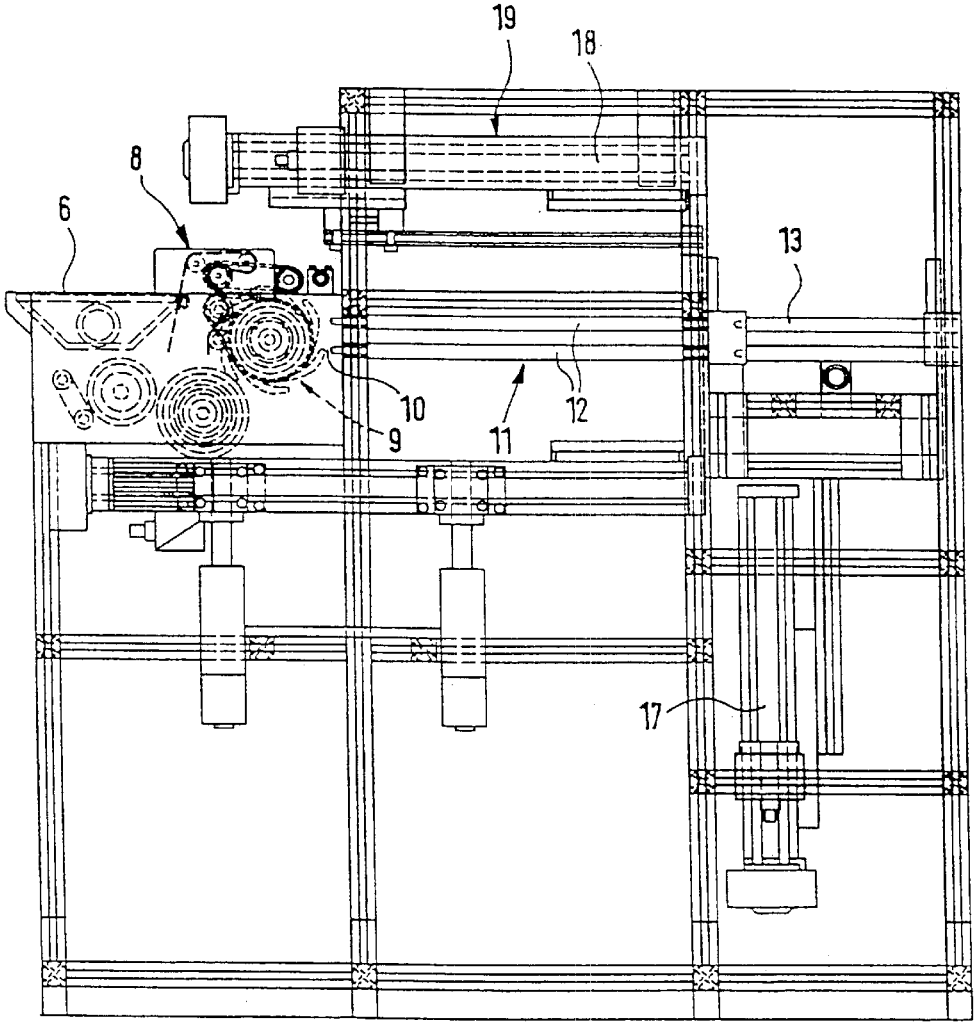
FIG. 2 is a device for conveying and stacking the punched-out workpieces.
Figure 3:
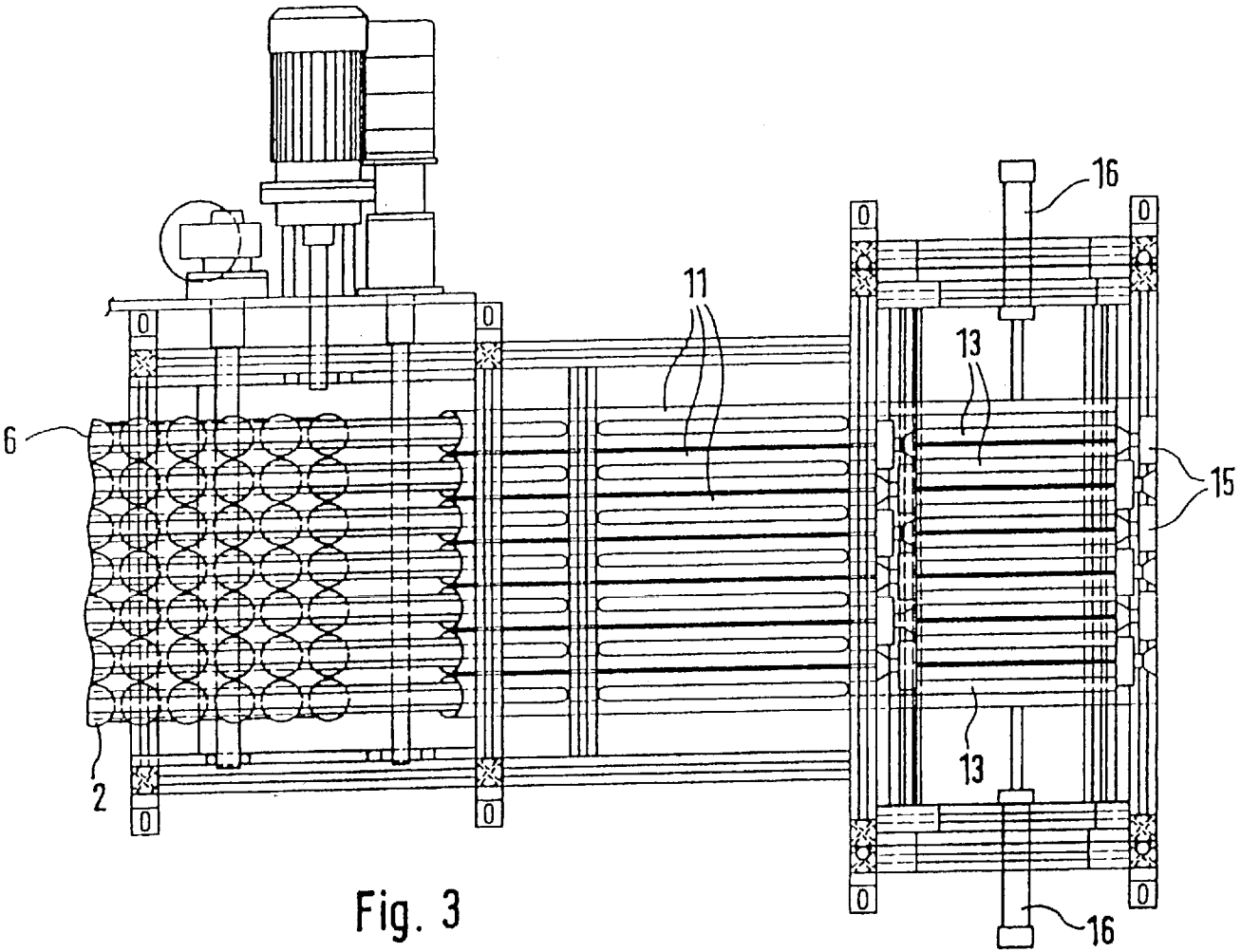
FIG. 3 is a top view of the device shown in FIG. 1.

FIG. 2 shows the continuation of the conveyor belt 6 that carries the workpieces 2, as shown in FIG. 3, to a conveying and guiding unit 8. This conveying and guiding unit 8 is arranged at the end of the conveyor belt 6. The conveying and guiding unit 8 transfers the workpieces 2 to a star-shaped delivery element 9 that aligns the workpieces 2 from a horizontal position into a vertical position in a fashion that is described in greater detail below. The workpieces 2 are transferred from the star-shaped delivery element 9 to a receptacle 10 (FIG. 4), where the workpieces 2 are deposited such that they are arranged upright one behind the other. A collection device 11 that is formed by several parallel rods 12 or tubes is adjacent to the receptacle 10. On these rods 12, the workpieces 2 are displaced in the direction of a transfer cartridge 13 by means of a conveyor finger 14 that can be moved vertically into the star-shaped delivery element 9 or into the collection device 11, respectively, and displaced in the direction of their longitudinal axes.

FIG. 3 indicates that a total of seven conveyor belts 6 are arranged adjacent to one another, and the workpieces 2 are arranged one behind the other on the conveyor belts. Consequently, the same number of conveying and guiding devices 8 as star-shaped delivery elements 9 that are arranged underneath the conveying and guiding units 8 and that insert the workpieces 2 into the transfer cartridges 13 by means of the collection devices 11 are connected to the conveyor belts 6. These transfer cartridges 13 are connected to one another by means of chain links 15 and can be transferred from a retracted position that is shown in FIG. 3 into a not-shown expanded position, in which the individual transfer cartridges 13 are spaced apart by predetermined distances, by means of lifting and pulling cylinders 16 that can apply forces on two sides and that engage the outer transfer cartridges 13. In addition, the transfer cartridges 13 can be raised from a position, in which they are arranged flush with the collection devices 11, by means of a drive 17 such that they are arranged flush with the ram 18 of an ejector unit 19. The workpieces 2 in the transfer cartridges 13 are pushed into filling cartridges (not-shown) by means of this ejector unit 19. The workpieces 2 are subsequently packaged in a suitable packaging machine with the aid of these filling cartridges. The distance between the transfer cartridges 13 can be adjusted so that it corresponds to the distance between the filling cartridges arranged adjacent to one another.

Figure 4:
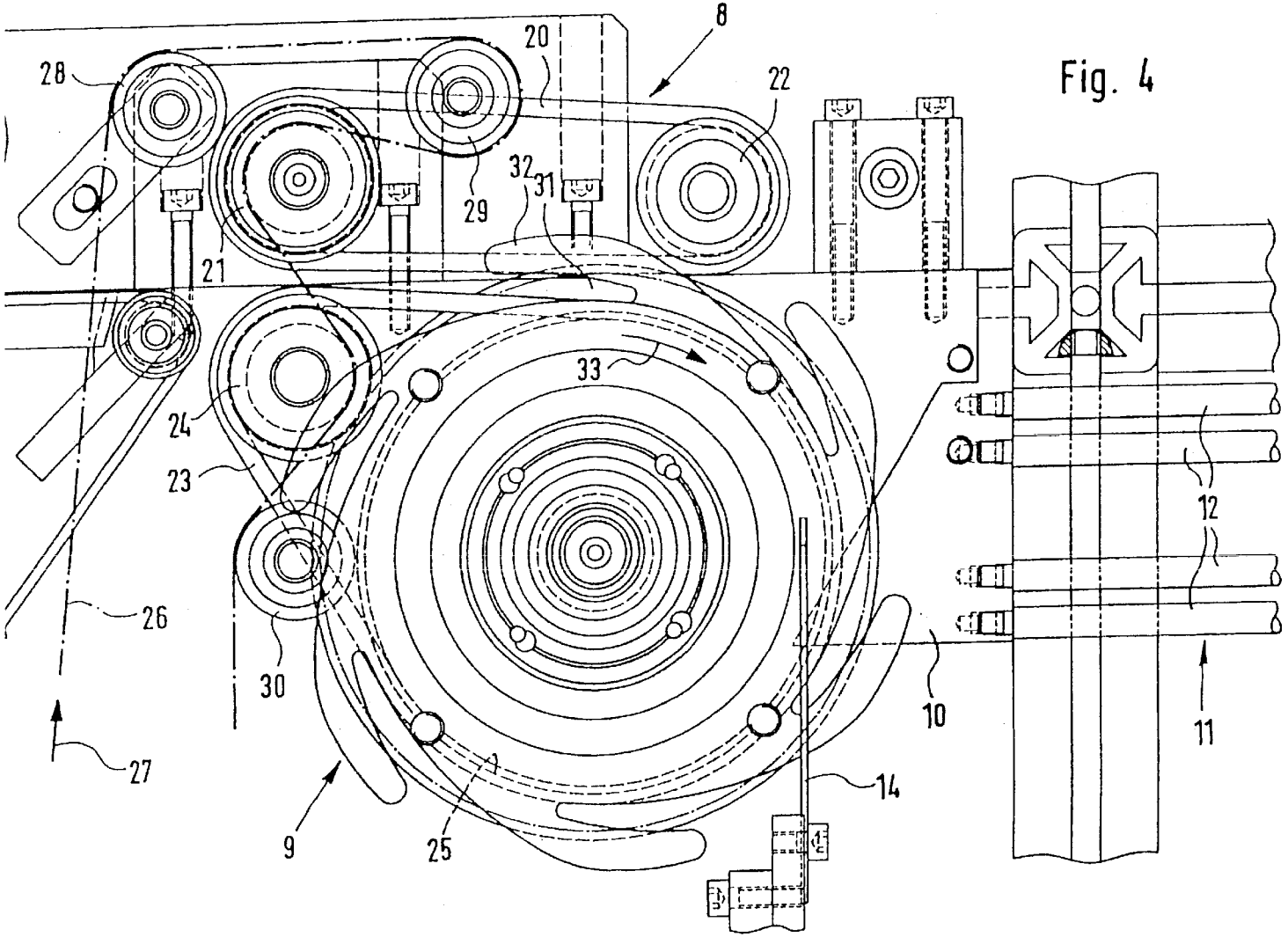
FIG. 4 is a side view of a star-shaped delivery element with a conveying and guiding unit.

FIG. 4 shows the conveying and guiding unit 8 as well as the star-shaped delivery element 9 which are connected to the conveyor belt 6. The conveying and guiding unit 8 contains an upper conveyor band 20 which is placed around a driven conveyor roll 21 and a deflection roll 22. The conveying and guiding unit 8 additionally contains a lower conveyor band 23 that is placed around a conveyor roll 24 as well as a section 25 of the star-shaped delivery element 9. A driving belt 26 can also be seen that revolves in the direction of the arrow 27 and extends around the deflection rolls 28 and 29, the conveyor rolls 21 and 24 as well as a deflection roll 30. Due to this measure, the two conveyor rolls 21 and 24 are driven at the same angular velocity. The conveyor band 23 also drives the star-shaped delivery element 9. However, this delivery element 9 may also be driven by a separate driving motor.

FIG. 4 also indicates that the gap between the two conveyor bands 20 and 23 widens continuously. The workpieces are guided into a receptacle 31 of the star-shaped delivery element 9 which is arranged flush with the gap between the two conveyor bands 20 and 23. A workpiece 2 in the receptacle 31 is taken hold of by a conveyor finger 32 and held on the conveyor band 23 such that the workpiece is conveyed in the direction of the arrow 33, i.e., in the rotating direction of the star-shaped delivery element 9. The workpiece is lifted 2 out of the receptacle 31 as soon as the workpiece 2 is inserted into the receptacle 10 and contacts the base of the receptacle 10.

Consequently, the transfer of the workpieces 2 from the conveyor belt 6 into the conveying and guiding unit 8 and the transfer from the conveying and guiding unit into the star-shaped delivery element 9 takes place without applying excessive forces on the workpiece 2, so that the workpiece 2 is additionally conveyed in a careful fashion. In addition, the conveying of the workpiece 2 in the star-shaped delivery element 9 is realized by contact of the workpiece 2 with the conveyor band 23 such that abrupt changes in speed, in particular, a deceleration of the workpiece 2, is prevented in all cases. The workpieces 2 are reliably conveyed without slipping if suitable conveyor bands 20 and 23 are chosen, e.g., conveyor belts with a rubber surface or O-rings.

What is claimed is:

1. A conveyor device with a conveyor belt for transporting workpieces from a forming machine and a star-shaped delivery element having receptacles for accommodating horizontally received workpieces and placing the horizontally received workpieces substantially vertical, wherein the star-shaped delivery element is preceded by a conveying and guiding unit which takes hold of the workpieces on one of a lower side and an upper side wherein the receptacles in the star-shaped delivery element are arranged essentially horizontally, so that the workpieces are introduced into the star-shaped delivery element in its circumferential direction characterized by the conveying and guiding unit is preceded by the conveyor belt and that conveying speeds of the conveying and guiding unit and the conveyor belt are essentially the same as the tangential conveying speed of the receptacles of the star-shaped delivery element.

2. The conveyor device according to claim 1, characterized in that the conveying and guiding unit is formed by one of a lower and an upper conveyor band.

3. The conveyor device according to claim 2, characterized in that the one of the lower and the upper conveyor band consists of one or more bands arranged adjacent to one another.

4. The conveyor device according to claim 2, characterized in that the conveying and guiding unit is formed by both a lower conveyor band and an upper conveyor band and that the lower and the upper conveyor bands have a common drive.

5. The conveyor device according to claim 1, characterized in that the star-shaped delivery element and the conveying and guiding unit have a common drive.

6. The conveyor device according to claim 1, characterized in that the star-shaped delivery element is driven by the conveying and guiding unit.

7. The conveyor device according to claim 1, characterized in that the star-shaped delivery element and the conveying and guiding unit are provided with separate drives.

8. The conveyor device according to claim 1, characterized in that a receptacle is provided at the outlet of the star-shaped delivery element.

9. The conveyor device according to claim 8, characterized in that the receptacle has a slotted end defining at least one slot, conveyor fingers of the star-shaped delivery element engage in the at least one slot, and the slotted end of the receptacle lifts the workpieces out of the star-shaped delivery element.

10. The conveyor device according to claim 8, characterized in that a tubular collection device is arranged adjacent to the receptacle.

11. The conveyor device according to claim 10, characterized in that the tubular collection device is formed by several rods between which the workpieces are guided.

12. The conveyor device according to claim 10, characterized in that a conveyor device is provided, wherein the conveyor device engages one of the star-shaped delivery element and the collection device, and is displaceable in the direction of the longitudinal axis of the collection device.

13. The conveyor device according to claim 12, characterized in that the conveyor device can be moved into the collection device after a predetermined quantity of workpieces are deposited in the collection device.

14. The conveyor device according to claim 10 characterized in that a transfer cartridge is provided adjacent to the collection device.

15. The conveyor device according to claim 14, characterized in that the transfer cartridge can be displaced perpendicularly to the longitudinal axis of the collection device from an outlet of the collection device.

16. The conveyor device according to claim 15, characterized in that a plurality of transfer cartridges are arranged adjacent to one another, the transfer cartridges being displaced in the vertical direction and expanded.

17. The conveyor device according to one of claim 14, characterized in that an ejector unit is moved into the transfer cartridge.

18. The conveyor or device of claim 4, characterized in that the common drive consists of a driving belt.

* * * * *